United States Patent [19]

Schwartz

[11] Patent Number: 4,833,803

[45] Date of Patent: May 30, 1989

[54] PICTURE FRAME

[75] Inventor: Richard Schwartz, Mutton Town, N.Y.

[73] Assignee: North American Enclosures, Inc., Central Islip, N.Y.

[21] Appl. No.: 130,447

[22] Filed: Dec. 9, 1987

[51] Int. Cl.[4] ..... G09F 1/12

[52] U.S. Cl. ..... 40/152; 40/155; 403/295

[58] Field of Search ..... 40/155, 152; 403/401, 403/402, 403, 295

[56] References Cited

U.S. PATENT DOCUMENTS

| | | | |
|---|---|---|---|
| 1,558,987 | 10/1925 | Kallscheuer | 40/155 |
| 3,899,844 | 8/1975 | Munn | 40/152 |
| 4,136,470 | 1/1979 | Barz | 40/152 |
| 4,356,648 | 11/1982 | Beaulieu | 40/152 |
| 4,357,744 | 11/1982 | McKenzie et al. | 403/295 |
| 4,547,986 | 10/1985 | Sherman | 40/155 |
| 4,630,386 | 12/1986 | Wilson | 40/155 |

FOREIGN PATENT DOCUMENTS

| | | | |
|---|---|---|---|
| 2823029 | 11/1979 | Fed. Rep. of Germany | 40/155 |
| 8605668 | 10/1986 | PCT Int'l Appl. | 40/152 |

*Primary Examiner*—Robert P. Swiatek
*Assistant Examiner*—Cary E. Stone
*Attorney, Agent, or Firm*—Howard C. Miskin

[57] ABSTRACT

A picture frame includes four legs delineating a rectangular opening and coupling members joining the adjacent ends of the legs, each leg including a longitudinal outer web, a high front flange and a low rear flange projecting upwardly from the web front and rear edges and coplanar legs projecting toward each other from the flanges to form confronting channels and each coupling member includes a corner angle section with arms terminating at their ends in mutually perpendicular faces and rectangular tongues offset from the edges of and projecting from the ends faces into sliding engagement with the channels of adjacent frame legs, the front and peripheral faces of the end sections being coplanar with the leg front flange front faces.

5 Claims, 3 Drawing Sheets

FIG. 1
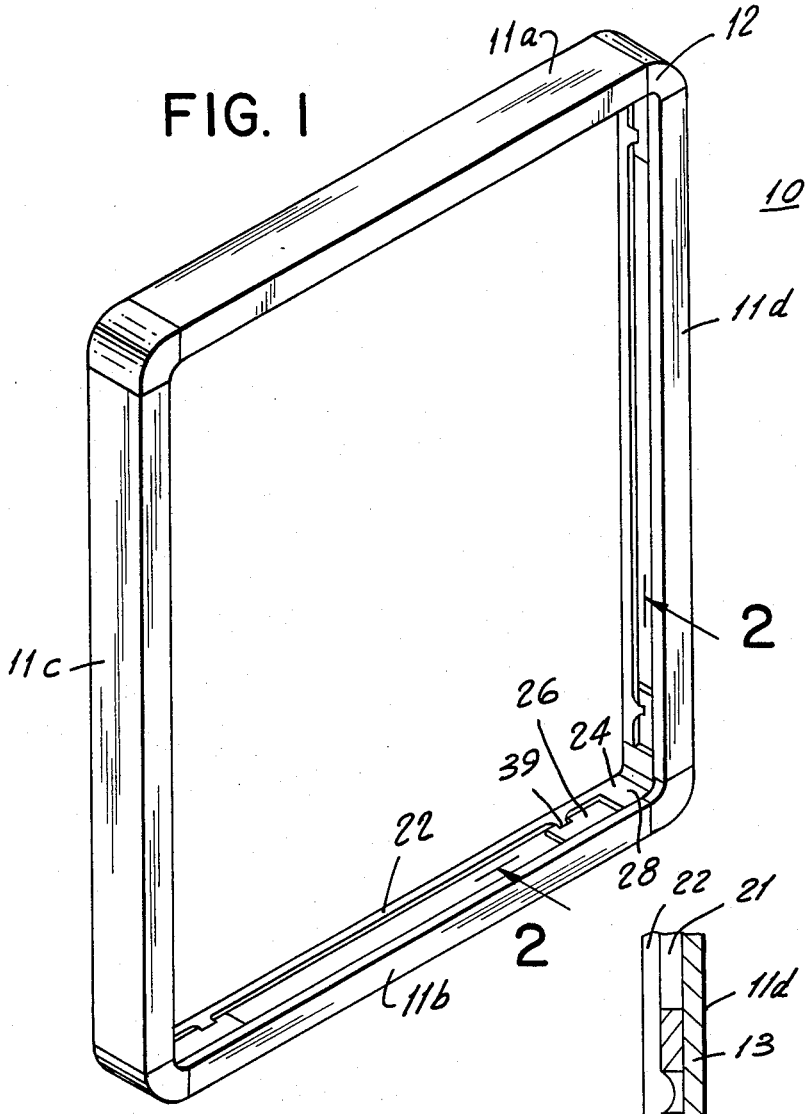
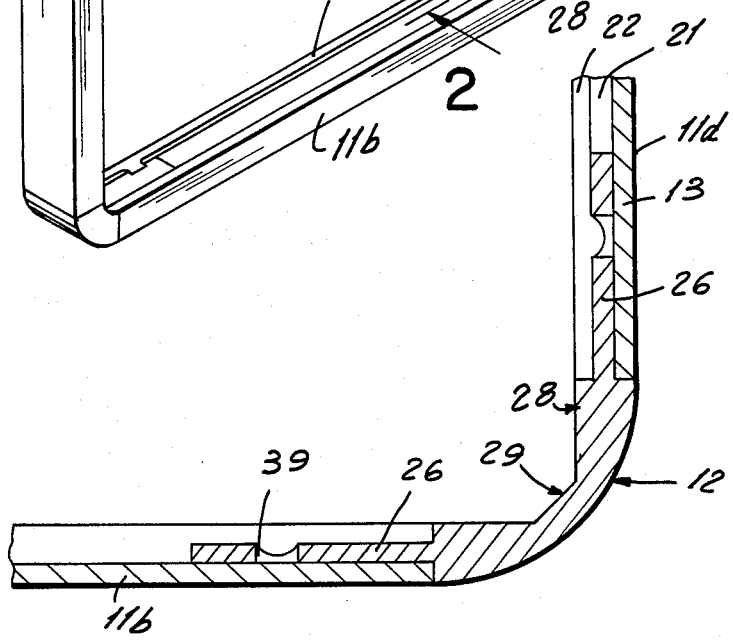
FIG. 2

PICTURE FRAME

BACKGROUND OF THE INVENTION

The present invention relates generally to improvements in display devices and it relates particularly to an improved picture frame.

In displaying or exhibiting pictures generally such as paintings, prints, photographs, documents and the like it is the common practice to mount the picture in a picture frame which supports the picture without stressing or damaging the picture and optimumly displays or exhibits the picture and permits the convenient positioning of the picture on a wall or otherwise. The conventional picture frame includes four quadralaterally disposed legs delineating a rectangular window, the adjacent ends of the legs being fixed to each other by brads, nails, glue, angle connectors or the like. The assembly of such a picture frame is time consuming and requires a high degree of skill and is thus expensive. Moreover, it is of little versatility and adaptability and otherwise leaves much to be desired.

SUMMARY OF THE INVENTION

It is a principal object of the present invention to provide an improved display device.

Another object of the present invention is to provide an improved picture frame.

Still another object of the present invention is to provide a picture frame which is assembled from a minimum number of similar components which may be conveniently, rapidly and easily assembled with a minimum of skill and in its unassembled condition is compact and easy to package, store and dispense.

A further object of the present invention is to provide a picture frame of the above nature which can be adapted to pictures of a large range of sizes and dimensions, is of attractive appearance, inexpensive and of great versatility.

The above and other objects of the present invention will become apparent from a reading of the following description taken in conjunction with the accompanying drawings which illustrate a preferred embodiment thereof.

A picture frame in accordance with the present invention includes four frame legs arranged to delineate a rectangular window and coupling members joining adjacent ends of the frame legs characterized in that each of the frame legs includes a longitudinal outer webs having along its opposite edges open ended channels with confronting longitudinal openings and each of the coupling members includes a corner section and mutually perpendicular tongues projecting from the corner section into sliding engagement with pairs of channels of respective frame legs.

In the preferred construction of the picture frame each frame leg includes a front wall projecting inwardly from the outer web front edge and terminating in a rearwardly directed flange and has end faces perpendicular to the leg longitudinal axis. The coupling member corner section is an angle member having a 90° curved outer face, flat mutually perpendicular inside faces and a front wall extending between end faces of the corner section which are mutually perpendicular. The coupling tongues are flat and rectangular and the faces and side edges are inwardly offset from the edges of each respective corner section end face. Thus the end face of each frame leg coincides with an end face of a respective coupling member corner section arm. The improved frame is rapidly and easily assembled from only two types of components, frame legs and coupling members and is adaptable to pictures of any dimensions and is inexpensive, attractive, rugged, reliable and of great versatility.

BRIEF DESCRIPTION OF THE DRAWINGS

FIG. 1 is of front perspective view of a picture frame embodying the present invention;

FIG. 2 is an enlarged sectional view taken along line 2—2 of FIG. 1;

DESCRIPTION OF THE PREFERRED EMBODIMENT

Figure 3:
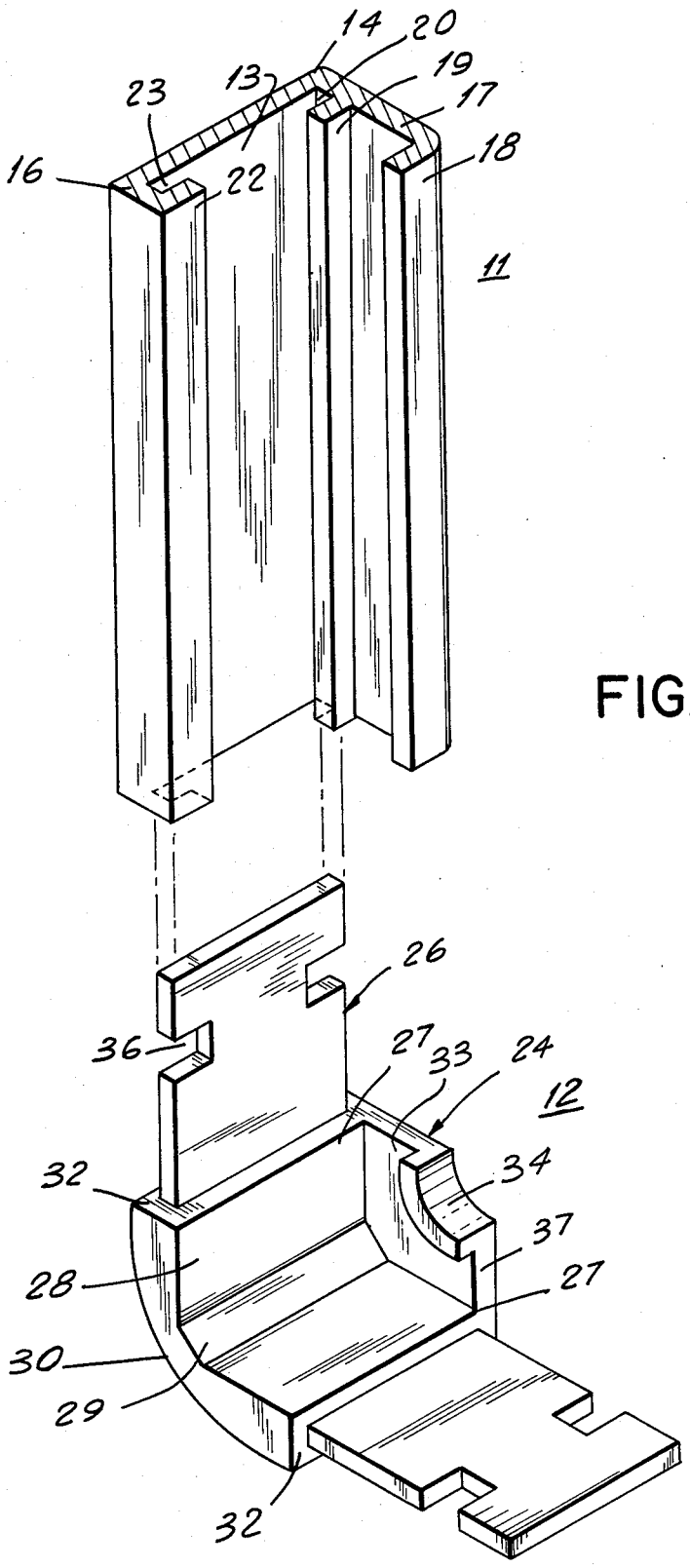
FIG. 3 is a fragmentary enlarged perspective view of components of the frame attendant to their assembly.
Figure 4:
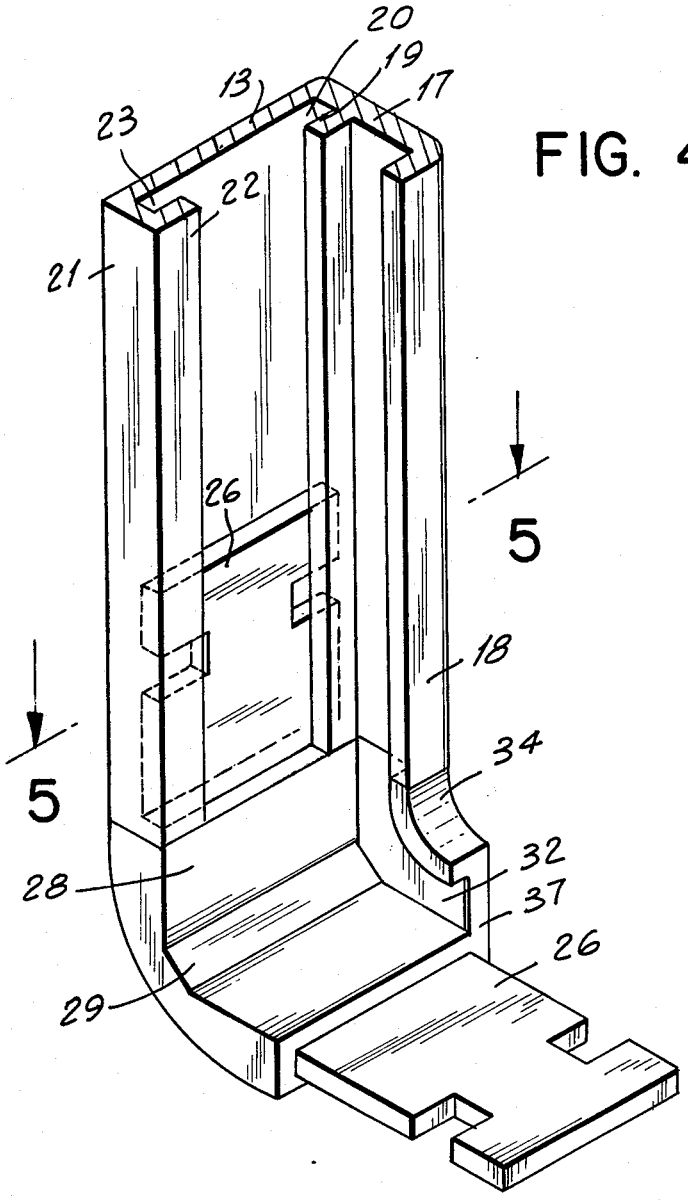
FIG. 4 is a view similar to FIG. 3 but shown in assembled condition.
Figure 5:
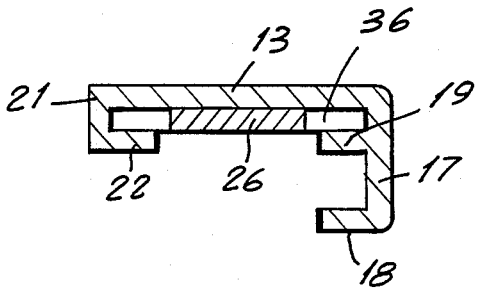
FIG. 5 is a sectional view taken along line 5—5 in FIG. 4.
Figure 6:
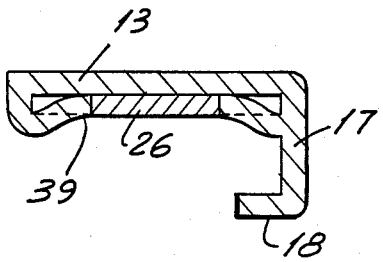
FIG. 6 is a view similar to FIG. 5 showing the assembled components in interlocked condition.

Referring now to the drawings which illustrate a preferred embodiment of the present invention, the reference numeral 10 generally designates the improved picture frame which, in its assembled condition, delineates a rectangular opening or window of any desired dimensions. Frame 10 comprises four frame legs 11 of similar configuration which includes vertically spaced horizontal parallel upper and lower legs 11a and 11b and horizontally spaced vertical parallel side legs 11c and 11d, the ends of respective legs being proximately spaced and joined by right angle coupling members 12.

The legs 11 are of uniform transverse cross section and preferably formed by extrusion of any suitable material, for example aluminum or an alloy thereof, anodized or otherwise coated or decorated. Each leg 11 is integrally formed and includes an elongated base or outer web or strip 13 with parallel longitudinal front and rear side edges 14 and 16. Projecting inwardly and extending for the full length of each leg front edge 14 is a relatively deep front wall about perpendicular to base web 13 and terminating along its top in a rearwardly projecting flange 18. The front face of front wall 17 may be flat or curved or otherwise shaped. Also projecting inwardly from each leg front wall 17 and extending for the length thereof is a flange 19 spaced inwardly of and paralled to web 13 and defining therewith a longitudinal channel 20 open inwardly and at the ends thereof.

A low longitudinal wall 21 projects inwardly along the full length of rear edge 21 and perpendicular to web 13 and terminates in a forwardly projecting flange 22. Wall 21 and flange 22 delineate with web 13 a channel 23 open at its ends and having a rear longitudinal opening confronting the front longitudinal opening of channel 20. The end faces of each leg 11 lie in transverse planes perpendicular to the respective web 13.

Each of the coupling members 12 is preferably injection molded of a thermoplastic synthetic organic polymer composition or other suitable material and includes a corner section 24 and a pair of mutually perpendicular coupling tongues 26. The corner section 24 includes a pair of mutually perpendicular arms 27 having flat rectangular inside faces 28 at right angle to each other and joined at their inner transverse edges by a 45° inclined face 29. The outside peripheral face 30 of angle section 24 is of arcuate cylindrical configuration and extends for 90° between the outer edges of the end faces 32 of corner section 24, each end face 32 being or rectangular configuration and lying in mutually perpendicular planes. A front wall 33 extends between the front edges of corner section arms 27 with its rear face inside inner edges extending along the front edges of faces 28 and 29 and with its front face 37 being coplanar with the front faces of arms 27. The inner corner of wall 33 is arcuately recessed and a 90° arcuate cylindrical flange 34 projects rearwardly from the edge of the arcuate recess. Projecting peripherally from the end faces 32 of corner section 24 are the mutually perpendicular tongues 26 each of which is of rectangular configuration and of a width slightly less than the distance between the confronting faces of walls 17 and 21 which define the bases of channels 19 and 23. Formed proximate the outer end of each tongue 26 in its side borders are rectangular notches or recesses 36. The tongues 26 are medially located in arm end faces 32 and are each of a width less than the width of leg web 13 by the sum of the thicknesses of leg walls 17 and 21 and of a thickness slightly less than that of channels 20 and 23. The heights of the end faces 37 of corner section front wall 33 is equal to that of leg front wall 17.

In assembling four legs 11 and four coupling members 12 to form the picture frame 10 the tongues 26 of each coupling member 12 is inserted and slid into full engagement with channels 19 and 23 of the proximate ends of mutually perpendicular frame legs and advanced to bring the frame leg end faces and the corner coupling angle section end faces into abutment. Upon the complete assembly of the four couplng members and frame sections 11 in the above member to form the assembled rectangular picture frame, the channel flanges 22 overlying the tongue recesses 36 are deformed or upset into tight engagement with respective recesses 36 to form detents 39 locking each of the tongues 26 against longitudinal movement in respective channels 23 and hence along legs 10 to thus firmly lock the picture frame 10 in its assembled condition.

While there has been described and illustrated a preferred embodiment of the present invention it is apparent that numerous alterations, omissions and additions may be made without departing from the spirit thereof. For example other means may be provided for preventing the movement of the coupling tongues in their channel engaged positions than the recesses 36 and detents 39, the configuration of the faces of the coupling member may be modified and the like.

I claim:

1. A picture frame comprising orthogonally related top, bottom and side legs delineating a rectangular window and coupling members joining the adjacent ends of respective legs, each of said legs including a longitudinally extending outer web having a relatively shallow rear flange depending from and extending along the length of the rear edge of said web and terminating along its bottom edge in a forwardly directed rear lip and a relatively deep flange depending from and extending along the length of the front edge of said web and terminating in a rearwardly directed end lip and having a rearwardly directed front lip coplanar with said rear lip, the upper part of said front flange and said front lip and said rear flange and rear lip defining a pair of transversely spaced open ended channels with confronting longitudinal openings extending along the length of said leg and each of said coupling members being an intergrally formed unit and including a corner section with mutually perpendicular arms having peripheral outer faces and mutually perpendicular flat tongues projecting from said corner section into sliding engagement with pairs of said channels of respective adjacent legs, each of said tongues being of flat configuration with parallel side edges and being inwardly offset from said outer faces of respective corner section arms.

2. A picture frame comprising orthogonally related top, bottom and side legs delineating a rectangular window and coupling members joining the adjacent ends of respective legs, each of said legs including a longitudinally extending outer web having a relatively shallow rear flange depending from and extending along of the rear edge of said web and terminating along its bottom edge in a forwardly directed rear lip and a relatively deep front flange depending from and extending along the length of the front edge of said web and terminating in a rearwardly directed end lip and having a rearwardly directed front lip coplanar with said rear lip, the upper part of said front flange and said front lip and said rear flange and rear lip defining a pair of transversely spaced open ended channels with confronting longitudinal openings extending along the length of said leg and each of said coupling members being an integrally formed unit and including a corner section with mutually perpendicular arms having peripheral outer faces and mutually perpendicular flat tongues projecting from said corner section into sliding engagement with pairs of said channels of respective adjacent legs, each of said tongues having a notch formed in a side edge thereof and the lip of a respective channel overlying said edge being deformed to engage said notch.

3. The picture frame of claim 1 including means interlocking said tongues and legs against relative movement thereof.

4. The picture frame of claim 1 or 2 wherein each of said legs is of substantially similar uniform transverse cross section and terminates in opposite transverse end faces perpendicular to the longitudinal medial axis of the respective leg.

5. The picture frame of claim 1 or 2 wherein said frame legs are of extrusion formed metal and said coupling members are injection molded of a synthetic organic polymeric material.

* * * * *